United States Patent [19]

Shanks

[11] 4,038,799

[45] Aug. 2, 1977

[54] JOINER BULKHEAD METHOD AND APPARATUS

[75] Inventor: Gerald R. Shanks, Somers, N.Y.

[73] Assignee: Frigitemp Corporation, New York, N.Y.

[21] Appl. No.: 606,086

[22] Filed: Aug. 20, 1975

Related U.S. Application Data

[63] Continuation-in-part of Ser. No. 573,165, April 30, 1975.

[51] Int. Cl.[2] ..... B63B 3/56; E04B 2/28

[52] U.S. Cl. ..... 52/241; 52/404; 52/481; 52/741; 114/78

[58] Field of Search ..... 52/481, 741, 241, 404, 52/98, 79; 114/78

[56] References Cited

U.S. PATENT DOCUMENTS 3,623,290 11/1971 Downing ..... 52/481

*Primary Examiner*—J. Karl Bell

*Attorney, Agent, or Firm*—Herbert C. Schulze

[57] ABSTRACT

This invention is a new and unique method, and apparatus for performing said method, for the installation of bulkheads, together with ceilings, in ships or other locations and is distinguished by the utilization of a special system of preformed panels which are held in position by specially formed friction clamps erected between a friction holding header of special construction and footing fastened to the deck or floor, and is further characterized by heat transfer blocking fasteners.

1 Claim, 18 Drawing Figures

JOINER BULKHEAD METHOD AND APPARATUS

CROSS REFERENCE TO RELATED PATENT APPLICATIONS

This patent application is related to my copending application Ser. No. 573,165, filed Apr. 30, 1975 and this is a continuation-in-part thereof.

BACKGROUND OF THE INVENTION

1. Field of the Invention

This invention is in the general field of modular building elements, and is particularly directed to a modular bulkhead and ceiling installation method, as well as to the bulkhead and ceiling elements themselves, and is more particularly directed to a system for completed installation of rooms and the like upon ships or within other structures. It is further directed to such building elements providing fire wall protection.

2. Description of the Prior Art

The field of building elements is crowded with many developments of both modular and non-modular nature. A particular division of this field is a formation of rooms or the like by installation of bulkheads within ships, or other structures within ships or the like. It is normally required that certain conditions of fire resistance, vermin proofing, moisture proofing and the like be met. The prior art in this particular field has been generally met by metal paneling or by the use of special fire resistant materials such as specially processed asbestos panels or the like.

I am also familiar with the well known "Hauserman" building panels which are designed for installation in certain areas for modular elements.

However, there is not prior art directed to a complete system for the installation of modular bulkhead and ceiling panels, or the like, in utilizing inexpensive forming and installation techniques containing personally nonhazardous materials. Particularly, there is no system utilizing a uniform method of holding all of the elements necessary to form a room with interchangable and interlocking clipping elements and there has not previously been a system providing double bulkhead walls held together by a clip element utilizing an heat arresting block.

SUMMARY OF THE INVENTION

I have been investigating the field of construction by the use of bulkhead systems in marine applications for a long time and have been particularly concerned with the special requirements of the marine field, many of which are also desirable in other fields. Such requirements include, but are not limited to, thermal insullation, proper acoustical qualities, fire proofing, vermin resistance, and hygienic superiority.

In order to attempt to accomplish some of the desired characteristics, in the past, it has been common to install welded steel plates for walls, or to utilize specially formed asbestos materials and the like. In each case there are problems, particularly in the use of welded steel elements when it is desired to make an installation while other persons are utilizing, or working in the area. Also, it is difficult to make alteration due to the fixed nature of the installation.

Where specially formed asbestos panels or the like are used, there are frequently health hazards if the material must be cut and handled, as it normally is, due to the danger of asbestos particles in the air.

Certain other materials not having these characteristics are still undesirable as many of them can become infested by vermin or the like.

I have now conceived and developed a superior method for the installation of walls and ceilings within marine structure and other structures which eliminates most of the deficiencies in most of the prior systems.

In my method, modular panels are formed of light sheet metal having a core of insulating material, such as sheet rock, and having edges specially formed to provide a flat surface with a suitable butt-like edge upon one side and a clip edge suitable to engage edging clip elements in frictional relationship upon the other edge. These panels work in conjunction with posts formed of sheet metal and incorporating the clip formed as described, which posts are held in the desired position by simple footing elements on the deck, or floor, and a cooperating header element fastened to the overhead deck or other building structure.

Additionally, I have utilized the identical clipping arrangement for overhead panels which cooperate with the wall panels and form a continuous ceiling which may be removed in panels as desired for overhead work.

Further than this, I have developed corner elements which are rounded on their exterior corner for safety and which incorporate clipping elements which clip cooperatively with the post and bulkheading units. Also included are door jamb elements.

A thermo electric plastic, T.E.P., heat arresting block may be secured within a post assembly or clip elements by riveting, or the like. T.E.P. has a high resistance to flame and heat transfer and provides additional firewall safety where adjacent panels are joining at said posts or clips.

Compressed thermal insulation may be field applied to one side of a panel and act in furtherance of fire safety, sound proofing and climatic comfort.

It is the object of this invention to provide a complete modular bulkhead system;

Another object of this invention is to provide for a bulkhead and ceiling system in which the panels are not permanently installed but are easily demountable;

Another object of this invention is to provide such a system as described where the elements incorporate heat arresting means;

The foregoing and other objects and advantages of this invention shall become clear to those skilled in the art upon reading the following description of a preferred embodiment in conjunction with the appended drawings.

DESCRIPTION OF A PREFERRED EMBODIMENT

Figure 1:
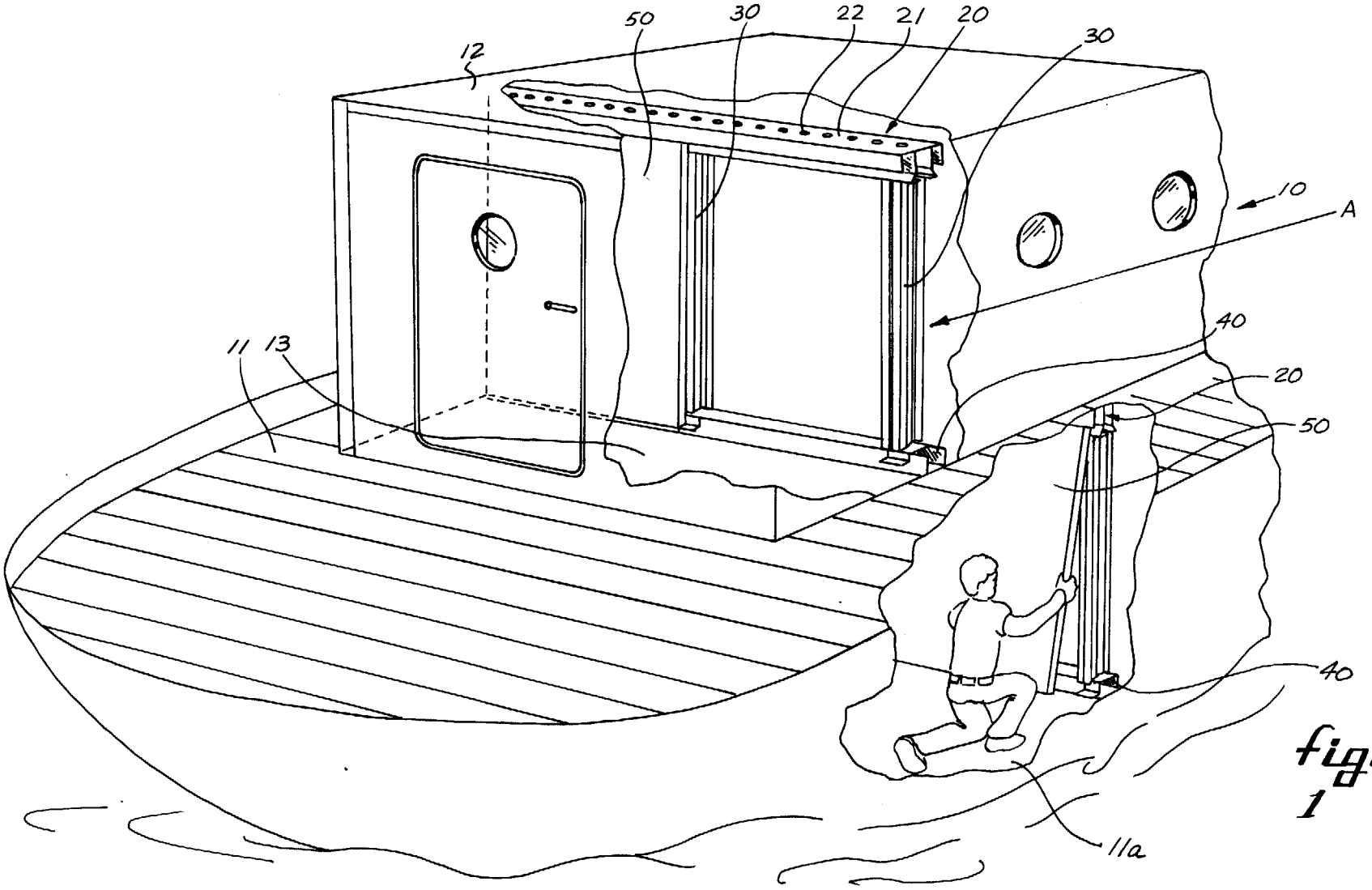
FIG. 1 is a partially broken away partial perspective of a ship utilizing a preferred embodiment of the elements to practice the method of this invention.

FIG. 1 illustrates a portion of a ship generally 10 having a deck 11 and a deckhouse 12, a lower interior deck 11*a*.

A partition generally "A", partially completed, is shown within the deckhouse. A similar structure is being formed upon the lower deck 11*a*. In this case it will be noted that a member generally 20 is utilized as a header and a member generally 40 is utilized for a footing for the construction. Posts generally 30 are provided running vertically between the footings and the headers to provide the studding and gripping elements to hold and support the bulkhead panels 50 which are installed for partitions.

Figure 2:
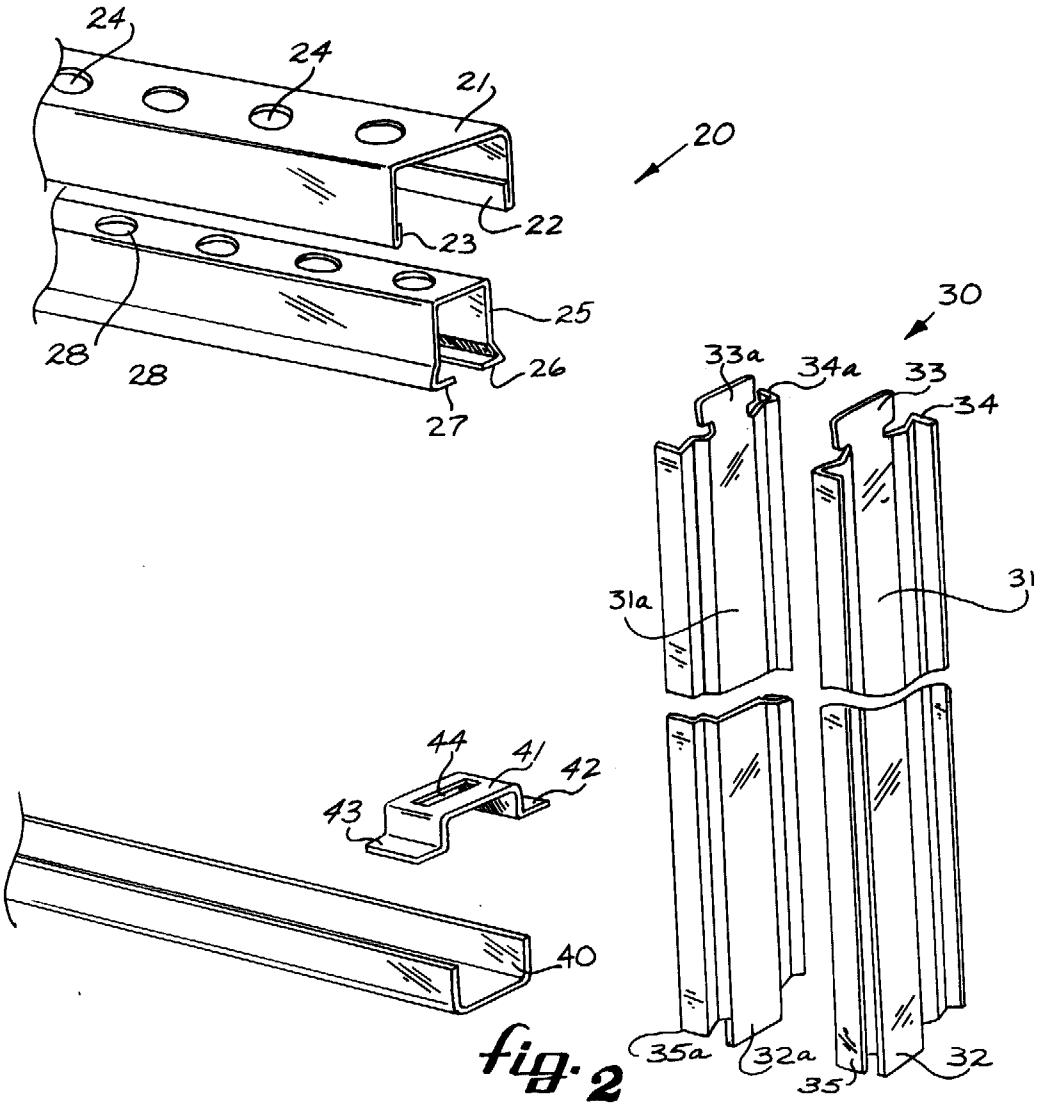
FIG. 2 is a partially broken away perspective, exploded, view of portions of the elements making up the posts, footings and headers utilized in the embodiment shown in FIG. 1.

FIG. 2 shows in more detail the elements from which the headers, footings and stud posts are formed. The header 20 comprises an essentially U shaped member 21 having folded inner edges 22 and 23 as shown together with an essentially U shaped inner piece 25 having spring grip formed portions 26 and 27 as indicated. A multiplicity of holes 24 are formed in element 21 and aligning holes 28 are formed in element 25; These holes provide accomodation for electrical conduit, pumping lines, and the like. The elements 21 and 25 are spot welded or otherwise fastened together to provide the completed header unit 20 as it is viewed in the other figures, such as in FIG. 4. The footing is seen to be an essentially U shaped member 40. Footing brackets 41 are provided at various locations as desired and will be welded or otherwise fastened to the U shaped member 40 with the opening 44 suitable to accomodate tabs 32, 32*a*, 33, and 33*a*, on posts 30 and will be hereinafter described. The flange elements 42 and 43 provide a bottom positioning stop for the bulkhead panels when in place so that they can not drop below the desired position.

Figure 3:
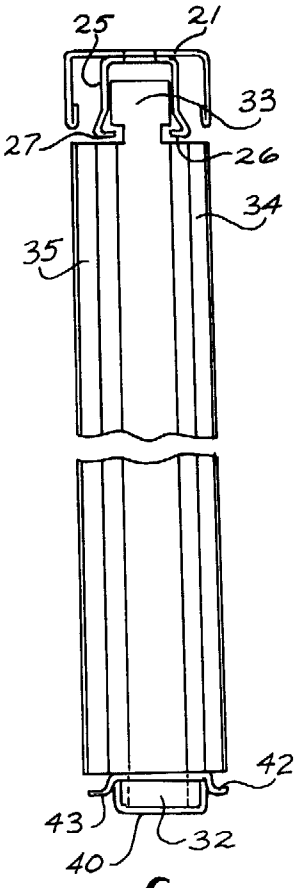
FIG. 3 is an end view of one post in position in the assembled heading and footing unit.

The stud post 30 comprises two elements which are mirror images of one another and are referenced as 31 and 31*a*. These two elements may be also, constructed as one unit. The tabs 33 and 33*a* fit into the element 25 in the manner indicated in FIG. 3. The bent exterior edges 34 and 34*a* and 35 and 35*a* are essentially of the configuration shown and are so formed as to cooperate with clipping elements on the panels which will be described below, with attention given to FIG. 5. It is obvious that the lower post tabs 32 and 32*a* are held in position within the slot 44 of element 41 and the footing member 40. The post may be welded to the bottom of the footing element 40 in order to assure rigidity. Once the panels are installed, as described below, the post will have a natural rigidity imparted between panels.

Figure 4:
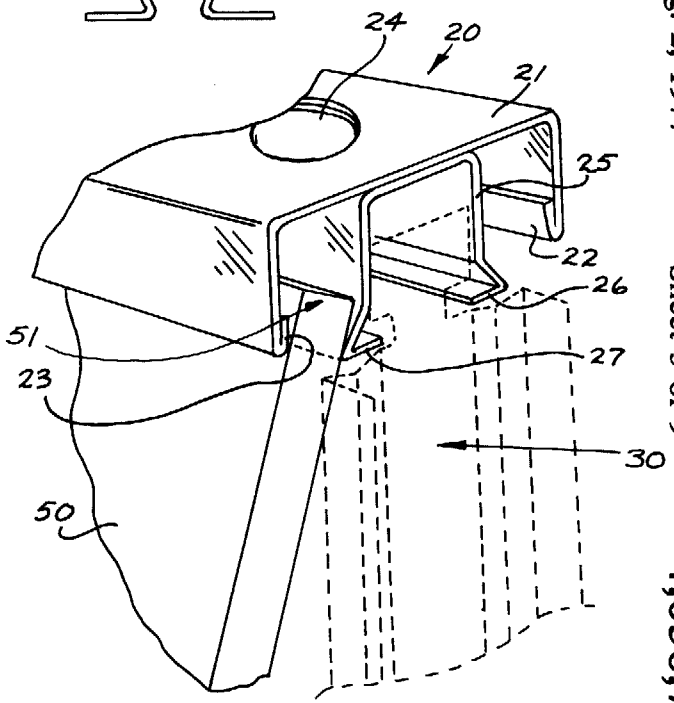
FIG. 4 is a partially broken away perspective of a bulkhead panel of this invention being installed in the header portion, with certain features indicated in phantom.

FIG. 4 illustrates the overall element 20 comprising the joined elements 21 and 25. It also illustrates the manner in which a bulkhead panel 50 is inserted.

For clarity of understanding this action, it should be understood that the panel 50 will be inserted under the outer lip of element 21 adjacent folded edge 23, essentially as indicated and the edge 51 will then be pressed into the opening between the two clip elements 23 and 27 on one side of post 30. The spring like action of the specially formed edge 27 will maintain a tension against the panel 50 and against the folded edge 23 of element 21. After the panel has been inserted, as shown in FIG. 4, it is merely necessary to push it firmly into position at its lower edge.

Figure 5:
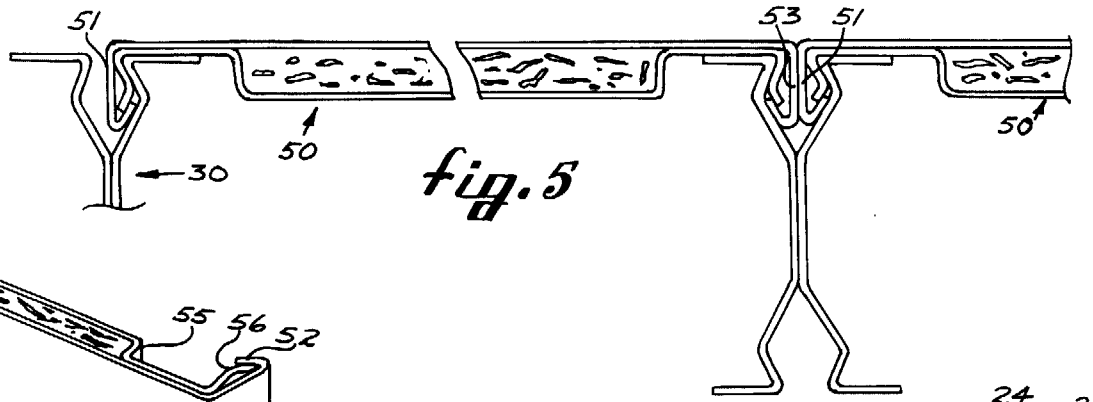
FIG. 5 is a partially broken away top view of a portion of a wall constructed according to the method, and using elements, of this invention.

When the panel has been completely inserted within the post clip elements a situation as shown in FIG. 5 will exist. Here it is seen that a panel 50 is held in position between the clip elements of two spaced posts 30. It is also shown that a second panel 50 will normally be placed adjacent the first panel 50 with the two panel edges 51 and 53 of adjacent panels being pressed together between the clip elements of one post 30.

Figure 6:
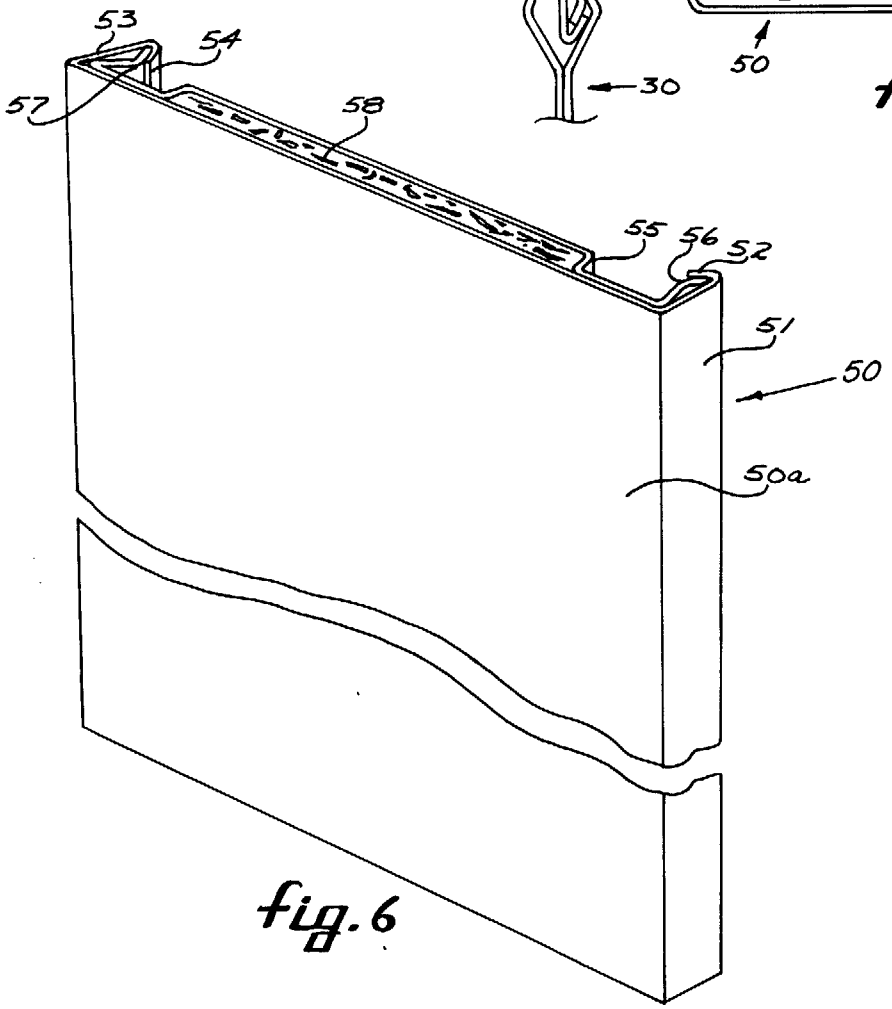
FIG. 6 is a partially broken away perspective of a bulkhead panel utilized in the method of this invention.

FIG. 6 illustrates the form and configuration of a bulkhead panel for use in this method. The panel 50 will consist of sheet metal or the like 50*a* having a formed edge 51 and formed edge 53, as indicated, with the ultimate edge 52 and 54 being formed so as to nest against the formed edge 56 and 57 respectively of the panel 55. The two panel members forming the entire panel 50 are spot welded or otherwise fastened where they join one another to form a single unit. Insulation material such as sheet rock or the like 58 is normally placed in the cavity between the two formed pieces of sheet metal or the like forming the bulkhead panel.

Figure 7:
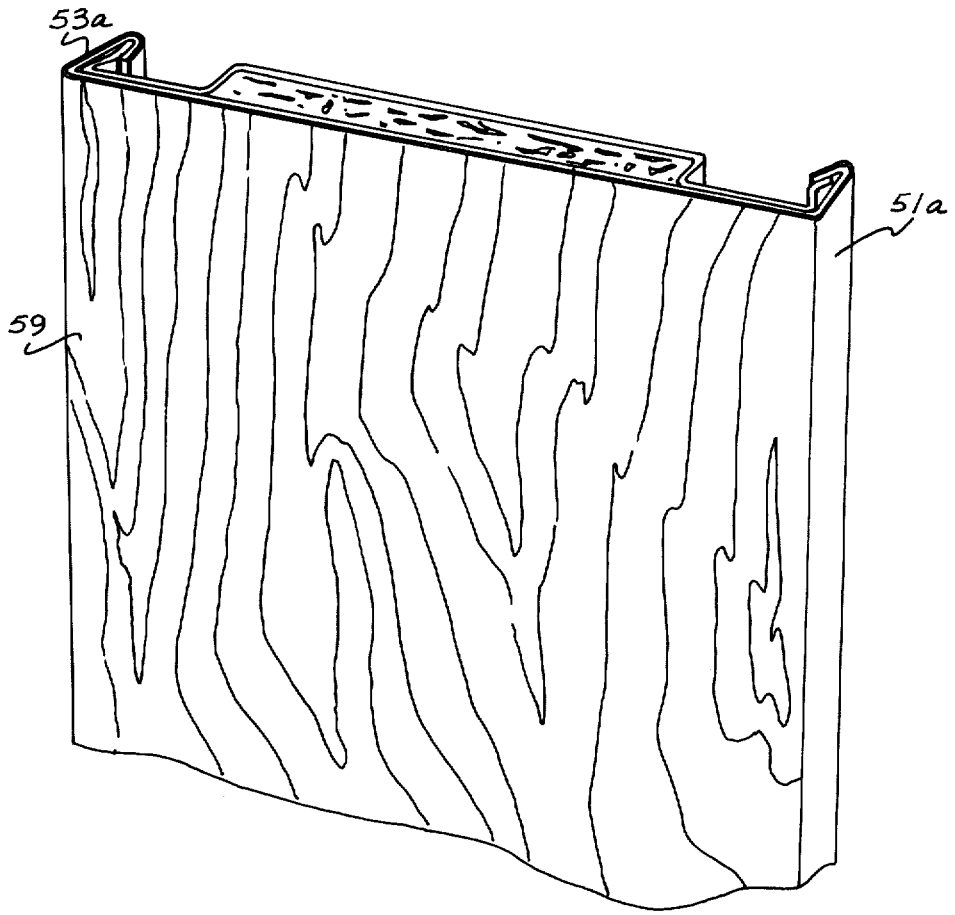
FIG. 7 is a partially broken away perspective view of a panel similar to that of FIG. 6 but with a different exterior coating.

FIG. 7 illustrates a portion of a panel of the same configuration as that shown in FIG. 6 but with one difference. The panel is formed in the same manner as is illustrated in FIG. 6. The edges 51*a* and 53*a* and the other folding features are the same for the corresponding items in FIG. 6. In this case; however, the metal used is shown to include a vinyl coating 59 by means known in the art, which vinyl coating 59 may have a decorative design, as indicated. The vinyl coated metal is particularly desirable for this installation since the vinyl provides a surface which slides easily into the spring post openings and slides easily against matching panels. At the same time, however, the vinyl coating does not interfere with the gripping, and forms an excellent structure.

Figure 8:
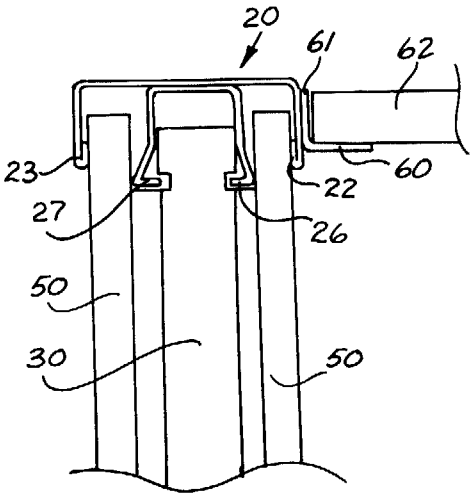
FIG. 8 is a partially broken away view of a header and ceiling support element in conjunction with the upper portion of the bulkhead wall unit.

FIG. 8 illustrates the upper portion of a bulkhead wall, consisting of two bulkhead panels 50, being held in position by post 30, and illustrating the manner in which the upper portion of the bulkhead panels 50 are held firmly by the spring member 26, pressing the bulkhead panel against the folded element 22 and likewise, the spring element 27, pressing the other bulkhead 50 against the folded element 23. In such a structure a hollow double-sided insulating wall has been formed. By the edge of "L" shaped brackets 60, welded, or otherwise fastened, to element 20 at 61, ceiling panels 62 of acoustical material or the like may be installed. It will be understood that such brackets 60 will be located upon the edges of header elements 20 and the ceiling panel 62 may be inserted in a customary manner.

Figure 9:
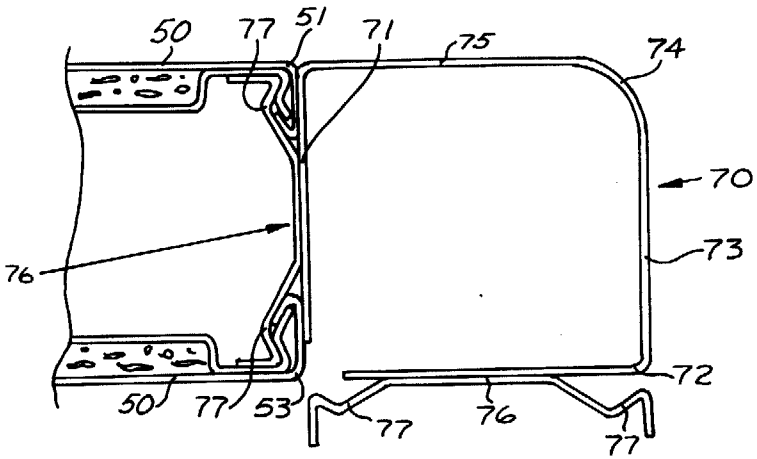
FIG. 9 is a top view of a corner element showing its cooperative relationship to the bulkhead panels.

FIG. 9 illustrates a special corner post which is a part of the method and system of this invention. In shipboard applications there are requirements that corner elements must be rounded, and this is desirable in all applications. It will be noted that the corner element generally 70 comprises an elongated member of the sheet metal or the like having been bent to the configuration 71, 75, 74, 73, and 72 to form an essentially rectangularly cross sectioned elongated member having a rounded corner 74. A clip member 76, formed by having two clip elements 77 so shaped as to cooperate with the clip edges 51 and 53 on bulkhead 50, is welded, or otherwise fastened to element 71. Another member 76 will be welded or otherwise fastened to the edge 72 of the corner member. Thus, it will be seen that a first double walled bulkhead arrangement formed in the manner as indicated in the preceding figures can terminate in this special corner and a second double walled element may proceed at a ninety degree relationship thereto. While FIG. 9 shows a 90° relationship, it should be understood that other relationships of the corner might be constructed by changing the configurations so as to make a corner of more or less than ninety degrees.

Figure 10:
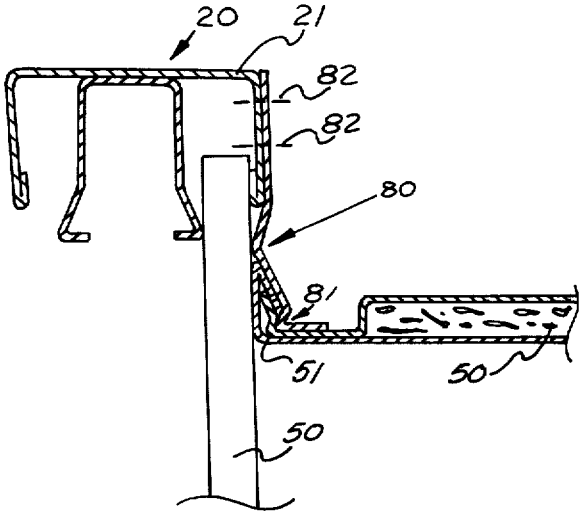
FIG. 10 is a partially sectioned, partially broken away view of an alternate embodiment of a header and ceiling support element mounted to the bulkhead panel.

FIG. 10 illustrates a portion of an alternate ceiling deck head arrangement. A portion of the element 20 and a bulkhead panel 50 is illustrated in FIG. 10 without all of the details of the post and the like so as to emphasize the gripping of the ceiling. It is observed that a member 80 having one edge bent as at 81 in such manner as to cooperate with an edge such as 51 of the normal bulkhead paneling as heretofore described, has been riveted as at 82 or otherwise fastened to one edge of element 21 of the header 20. The element 80, at the clip area 81 holds the gripping edge 51 against the bulkhead panel 50 as illustrated.

Figure 11:
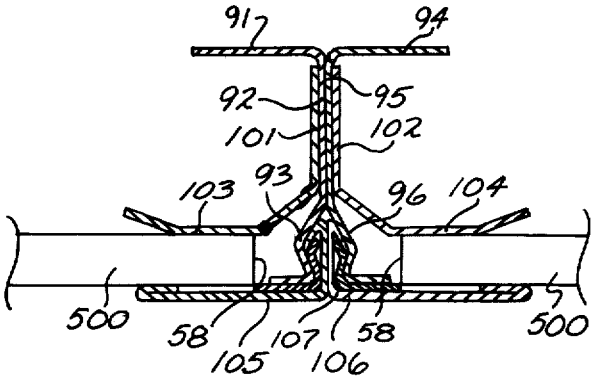
FIG. 11 is a partially sectioned, partially broken away view of the joinder of two ceiling elements with a support element.

FIG. 11 shows a trim strip arrangement utilized to cover the space between two adjoining panels of customary ceiling material when used, where they join the edge which is not a terminal edge. A short piece of ceiling clip element is illustrated and comprises the flange member 91, the carrier member 92, and the clip member 93 on one side with similar elements 94, 95, and 96 on the other side. These elements are riveted or otherwise fastened together and attached to members 101 and 102 essentially as illustrated. The members terminate in a configuration as shown at 103 and 104 respectively. A furring strip 105–106 joined at 107 in a clip configuration to clip into the clip element 90 covers the open area between the raw edges of panels 500. These panels 500 may be of any customary ceiling material.

Figure 12:
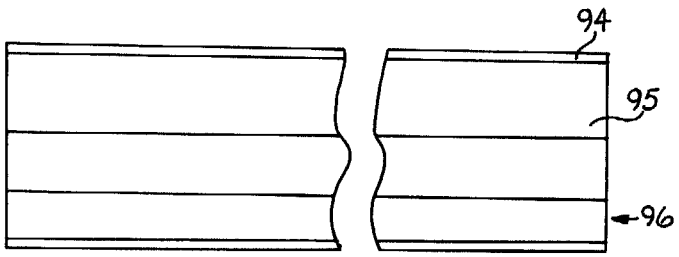
FIG. 12 is a partially broken away side elevation of the ceiling hanger unit utilized in the construction shown in FIG. 11.
Figure 13:
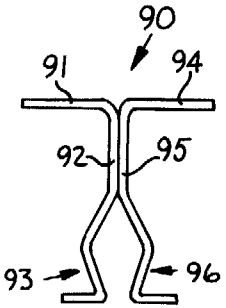
FIG. 13 is an end view of the element of FIG. 12.

A clip element 90 for use in hanging adjacent panels of ceiling (as in FIG. 11) by the adjacent edges is illustrated in FIG. 12 and FIG. 13. This comprises two elongated members having hangar elements 92 and 95, respectively, which will fasten together by welding or the like, each of which has a flange or the like 91 and 94 respectively and a clip arrangement 93 and 96 respectively. The flange elements 91 and 94 may be fastened to an overhead hangar or stud or to adjoining panels and may be clipped therein to hang overhead in a manner like that illustrated in FIG. 5 for vertical mounting.

Figure 14:
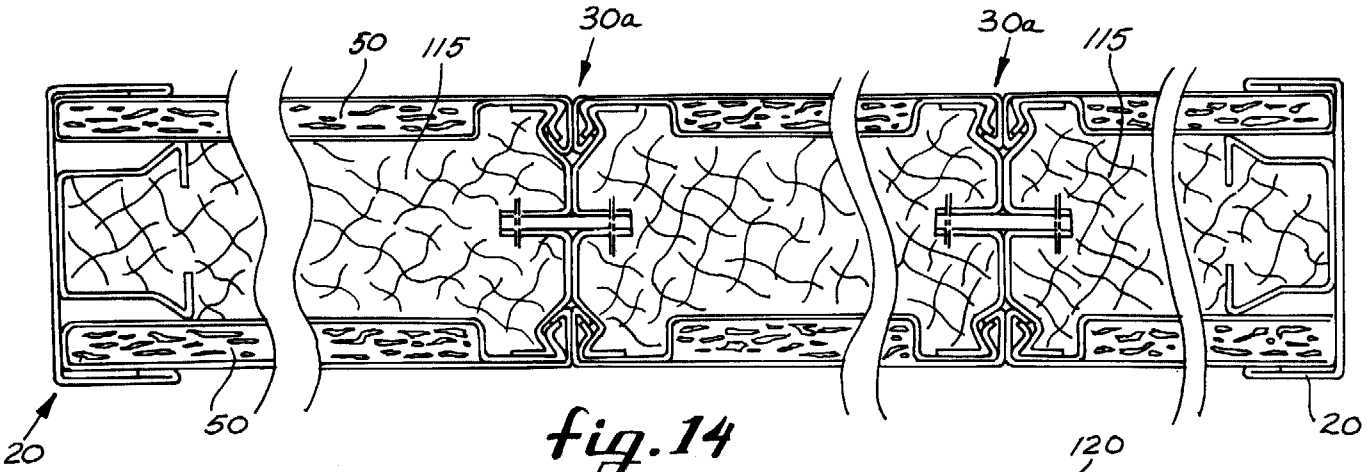
FIG. 14 is a partially broken away top view which displays a modified bulkhead mounting with heat arresting blocks, and insulation.

FIG. 14 illustrates the use of a modified post **30*a*. The basic details of construction and cooperative effect will be as in previous figures. Thermal insulation 115 may be applied between adjacent bulkhead panels 50, if desired. Also, illustrated here is the possibility of using a ceiling channel 20** (as used in FIG. 4).

Figure 15:
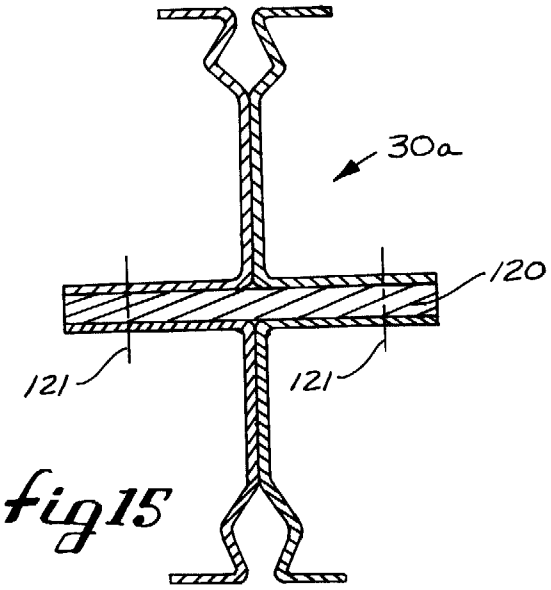
FIG. 15 is an enlarged sectional view of a bulkhead clip of FIG. 14.

FIG. 15 shows, in detail, a modified post **30*a* and this can be compared with a standard post 30 (see FIG. 2). The modified post 30*a* contains a thermo electric plastic, T.E.P., heat arresting block 120 which is secured within the post assembly by rivets 121** or the like.

Figure 16:
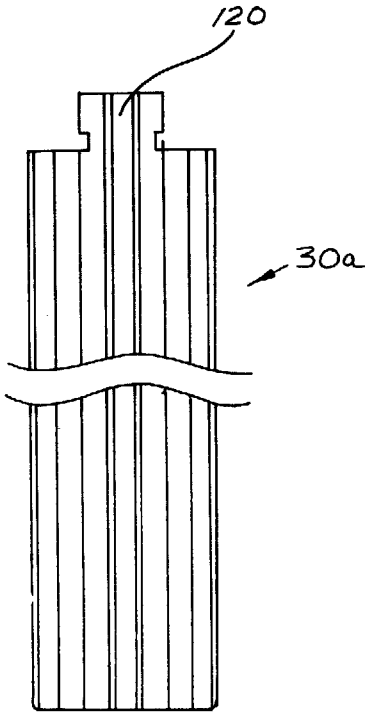
FIG. 16 is a partially broken away end view of the bulkhead clip of FIG. 14.

FIG. 16 is a side elevation of a modified post **30*a***.

Figure 17:
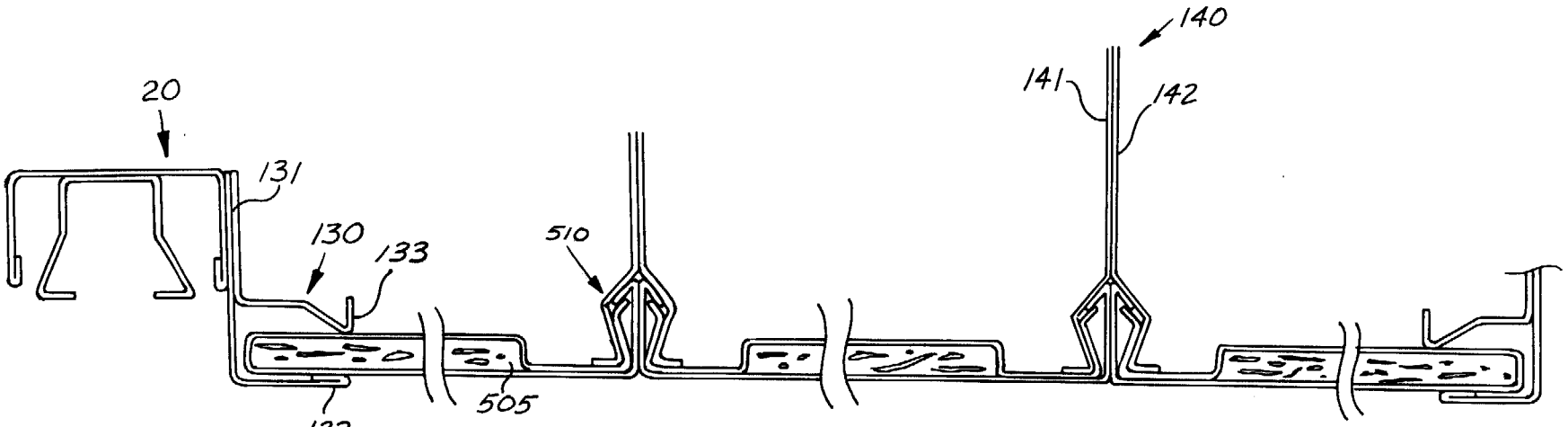
FIG. 17 is a partially broken away, partially sectioned, view of an alternative ceiling installation arrangement.

FIG. 17 is a typical ceiling installation using a modified ceiling channel 130 whereby 131 is fastened to a header 20. See FIGS. 8 and 10 for a view of header 20 and two types of ceiling channel arrangements. Specially formed end panel 505 (having one clip end and one plain end) will be inserted between elements 132 and 133. The spring like action of formed edge 133 will maintain a tension against panel 505 and edge 132. The opposite (clip) end of panel 505 will be pushed firmly into position at 510 and a second panel (which may be a standard panel 50) will be placed adjacent the first panel at 510 as is illustrated (similar to FIG. 5 at 51–53). Element 510 will be suspended into position by the use of depending edges or the like 141 and 142, which may be fastened to some suitable overhead structure.

Figure 18:
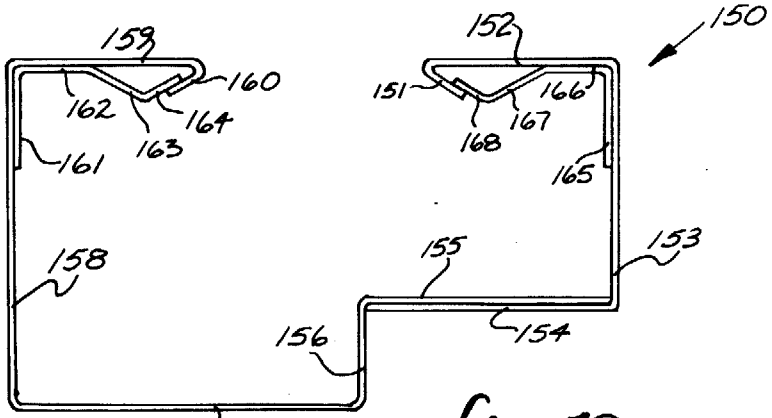
FIG. 18 is a top view of a door jamb post.

FIG. 18 illustrates how a specially designed post can be utilized as a door jamb and casing 150. The post is formed of four pieces. One piece is bent in the configuration 151-152-153-154. A second piece is bent as at 155-156-157-158-159-160. The third and fourth pieces are formed as at 161-162-163-164 and 165-166-167-168 respectively; in this manner they form recognizable clip elements of the type utilized throughout this invention. By reference to FIG. 9 it can be seen that post 150 could be inserted at clips 77 on the corner post 70 to be utilized as a door jamb. The door stop side will be at 154.

While the embodiments of this invention as shown and described are fully capable of achieving the objects and advantages desired, it is to be understood that such embodiments are for purposes of illustration only and not for purposes of limitation.

I claim:

1. The method for installing sub enclosures within a primary enclosure including:

1. Forming a plurality of insulated rigid panels, each having a clip element upon each of two opposed edges;
2. Forming a multiplicity of double elongated post elements, each including clip accommodation means on their opposed elongated edges;
3. Placing heat arresting blocks between said double post elements, each of which blocks is thermally and electrically insulative;
4. Fastening a footing to the floor element of the primary enclosure;

5. Fastening a header element to the overhead structure of the primary enclosure;
6. Fastening a plurality of said posts at spaced distances from one another extending between said footing and header elements;
7. Inserting a plurality of said panels with their clip edges within the clip accommodation means of said posts; and
8. Placing a plurality of ceiling panels in cooperative relationship above said wall panels.

* * * * *